US008939667B2

(12) United States Patent
Pahlck et al.

(10) Patent No.: US 8,939,667 B2
(45) Date of Patent: Jan. 27, 2015

(54) SHAPER

(75) Inventors: Harold E. Pahlck, Waldwick, NJ (US); Josephine A. Adams, Wyckoff, NJ (US); Leona Giat Fleissman, Ridgewood, NJ (US)

(73) Assignee: Avon Products, Inc, New York, NY (US)

( * ) Notice: Subject to any disclaimer, the term of this patent is extended or adjusted under 35 U.S.C. 154(b) by 563 days.

(21) Appl. No.: 12/442,417

(22) PCT Filed: Mar. 27, 2008

(86) PCT No.: PCT/US2008/058342

§ 371 (c)(1),
(2), (4) Date: May 7, 2009

(87) PCT Pub. No.: WO2008/124315

PCT Pub. Date: Oct. 16, 2008

(65) Prior Publication Data

US 2010/0028069 A1 Feb. 4, 2010

Related U.S. Application Data

(60) Provisional application No. 60/921,815, filed on Apr. 4, 2007.

(51) Int. Cl.

| | |
|---|---|
| ***B43K 29/06*** | (2006.01) |
| ***B43L 23/00*** | (2006.01) |
| ***B43K 23/10*** | (2006.01) |
| ***B43L 23/08*** | (2006.01) |
| *A45D 40/20* | (2006.01) |

(52) U.S. Cl.

CPC ..... *B43L 23/00* (2013.01); *B43K 23/10* (2013.01); *B43L 23/08* (2013.01); *A45D 2040/202* (2013.01)

USPC ..... 401/51; 401/52

(58) Field of Classification Search

USPC ..... 401/50, 51, 23, 202, 262, 52; 30/454; 132/200, 74.5, 320, 317

See application file for complete search history.

(56) References Cited

U.S. PATENT DOCUMENTS

| | | | | |
|---|---|---|---|---|
| 1,949,612 | A | 3/1934 | Mattair et al. | |
| 2,299,627 | A * | 10/1942 | Hunter et al. | 132/74.5 |
| 2,665,696 | A * | 1/1954 | Weis | 401/51 |
| 2,979,029 | A * | 4/1961 | Melnikoff | 401/51 |
| 3,768,915 | A * | 10/1973 | Spatz | 401/50 |
| 3,980,113 | A | 9/1976 | Birdsall | |
| 4,248,283 | A | 2/1981 | Kaye | |

(Continued)

FOREIGN PATENT DOCUMENTS

| | | | |
|---|---|---|---|
| DE | 2513051 | A1 | 10/1976 |
| DE | 10021989 | A1 | 11/2001 |

(Continued)

*Primary Examiner* — Melanie Tyson
*Assistant Examiner* — Viet Le
(74) *Attorney, Agent, or Firm* — David M. Joyal; Joan M. McGillycuddy

(57) ABSTRACT

A shaper for defining a tip portion of a cosmetic unit that has become worn includes a shaping surface for smoothing a surface of the tip portion and a slot in the shaping surface. The shaping surface is user-selectably placed in contact with the tip portion. An edge disposed at the slot and is engageable for removing material of the tip portion when the shaping surface is in contact with tip portion. The removed material is passed through the slot.

6 Claims, 8 Drawing Sheets

(56) References Cited

U.S. PATENT DOCUMENTS

| | | | | |
|---|---|---|---|---|
| 4,558,540 | A | 12/1985 | Collins | |
| 6,722,803 | B2 * | 4/2004 | Luttgens | 401/52 |
| 6,976,314 | B2 * | 12/2005 | Luttgens | 30/457 |
| 7,134,935 | B1 | 11/2006 | Papetti | |
| 2004/0049929 | A1 * | 3/2004 | Sterios | 30/453 |
| 2005/0102978 | A1 * | 5/2005 | Gueret | 53/471 |
| 2006/0080846 | A1 | 4/2006 | Luttgens | |

FOREIGN PATENT DOCUMENTS

| | | | |
|---|---|---|---|
| FR | 2672009 | A1 | 7/1992 |
| GB | 2252940 | A | 8/1992 |
| JP | 06-199093 | | 7/1994 |
| JP | 11-347265 | | 12/1999 |
| JP | 2002-119330 | | 4/2002 |

* cited by examiner 100
104
106a
8G, 8H
110a
110
8G, 8H
102a
104a
106

104
110
110a
106a
104d
112
112a 110a
110
112a
114
112
104d 109
104c
104

104c
104

104c
104

8C, 8D, 8E
100
104
109
8B
102
106
108a
108
106a
102a
104a
8B

100
B
109
A

SHAPER

CROSS-REFERENCE TO RELATED APPLICATIONS

This application claims priority to International Application Serial No. PCT/US08/58342 filed Mar. 27, 2008 which claims priority to U.S. Ser. No. 60/921,815, filed on Apr. 4, 2007, hereby fully incorporated by reference.

FIELD OF THE INVENTION

The present invention relates to cosmetic articles, and, in particular, to articles of manufacture and methods of use of such articles that shapes and/or defines a tip portion of a cosmetic unit that has become worn.

BACKGROUND OF THE INVENTION

Certain cosmetic articles comprise cosmetic units made of readily deformable solid or semi-solid material whose tips become worn in use. Typically, the tip or a portion of the tip loses its point. In addition, or instead, the tip may become irregularly shaped having areas where the material has accumulated while other areas have material removed.

A worn tip will fail to provide precise and consistent application. Rather, lines made by the tip will be wider than intended, accumulated areas will produce blotched area on the consumer, and removed areas will fail to leave a cosmetic on the consumer.

Knowledgeable consumers will shape the tip using a tissue or other means. The result may be only marginally more desirable than the worn tip as physically unstable tip portions are formed.

To improve on this, cosmetic manufacturers provide shapers in cosmetic articles. Known shapers are removably provided in an end of a holder opposite to the tip. Consumers must remove the shaper from tile distal end, reorient the holder, shape the tip, evaluate the result, and, if satisfactory, replace the shaper in the distal end of the holder.

In related cosmetic articles of pencils, a shaper is known to be placed on a cap. A holder includes a solid cosmetic unit. The holder is secured in a cavity of the cap at proximal end of the cavity until the consumer wishes to use the product.

The holder is then removed and if sharpening is desired, the cap is turned so that a second end, the distal end, is opposite the tip of the holder. The holder is then inserted into a second cavity and as is well known in the art a sharpening blade removes a portion of the pencil and the cosmetic unit to provide a sharp tip. However, to prevent injury from the sharp blade, a second cap typically covers the cap adding yet a further step to the process.

Each product lacks the inherent convenience of a shaper disposed in the cap to shape and/or define a portion of the tip of tile cosmetic unit.

As used herein, a cosmetic article refers to an article of manufacture used by a consumer that includes a cosmetic unit and a holder, for example, a lipstick that has a holder and lipstick unit. Cosmetic unit refers to an article of manufacture that includes a cosmetic agent that is applied to the body of the consumer.

SUMMARY OF THE INVENTION

A shaper for defining a tip portion of a cosmetic unit that has become worn which includes a shaping surface for smoothing a surface of the tip portion and a slot in tile shaping surface. The shaping surface is user-selectably placed in contact with the tip portion. An edge disposed at the slot and is engageable for removing material of the tip portion when the shaping surface is in contact with tip portion. The removed material is passed through the slot.

Another object of the invention is a shaper for defining a tip portion of a cosmetic unit that has become worn which includes a reservoir for holding a shaping chemical, which interacts with a cosmetic material of the cosmetic unit. The shaper also includes a shaping surface for transmitting the shaping chemical to the tip portion to smooth a surface of the tip portion. The shaping surface may be user-selectably placed in contact with the tip portion.

DETAILED DESCRIPTION OF THE DRAWINGS

In accordance with one embodiment of the present invention, a cosmetic article 10 includes a holder 12 and a cap 14 that shapes and/or defines a tip portion of a cosmetic unit held by the holder.

Cosmetic article 10 may be any suitable article as one skilled in the art will recognize from the description further herein. In particular, but not exclusively, cosmetic article 10 may be a full-line lipstick, a slim-line lipstick, a trim-line lipstick, an eye shadow, a concealer, a lip liner, an eye liner, a mechanical pencil, or any other suitable article.

Thus, holder 12 may have any suitable shape that is convenient for the user, that is suitable for holding the cosmetic unit, and/or that is desired for any reason. For example, holder may be circular in cross-section and have a small diameter for a lip liner or have a larger diameter for a lipstick. Thus, when holder 12 is a pencil, holder 12 may be polygonal in cross-section, or, for example, holder 12 may be rectangular when it is configured as a full-line lipstick.

The holder comprises a body 12*a* that firmly holds cosmetic unit 16 as is known in the art.

Holder 12 will maintain a tip 16*a* of the cosmetic unit exterior to a proximal end of body 12*a* so that a consumer can apply the cosmetic agent of the cosmetic unit to the consumer's body.

Figure 2F:
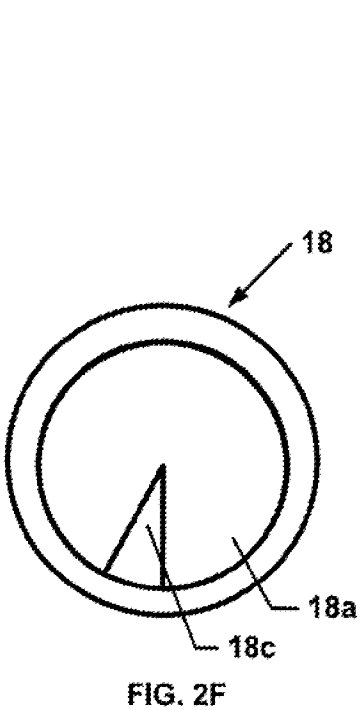
FIG. 2*f* is a planar view of the shaper of FIG. 2*e*.

Cosmetic unit 16 may be a solid or semi-solid that permits a portion of the tip to be shaped and/or defined to correct the surface when material is unevenly distributed in the tip. For example, as illustrated with respect to FIGS. 2*a* and 2*b*, where FIG. 2*a* is a cosmetic unit prior to use and FIG. 2*b* is a cosmetic unit after use, cosmetic unit 16 may comprise a material that becomes uneven with high spots 17*a* and low spots 17*b* on the surface.

Preferably, the material has properties that permit correction in shape. Thus, when a surface that is less flexible than the material of the cosmetic unit is applied to the cosmetic unit and the cosmetic unit rotates relative to the surface, material moves from the areas of accumulated material to areas of removed material or is removed from the cosmetic unit. Similarly, cosmetic unit 16 is preferably response to heat and/or chemical such that material moves from the areas of accumulated material to areas of removed material or is removed from the cosmetic unit.

Figure 1E:
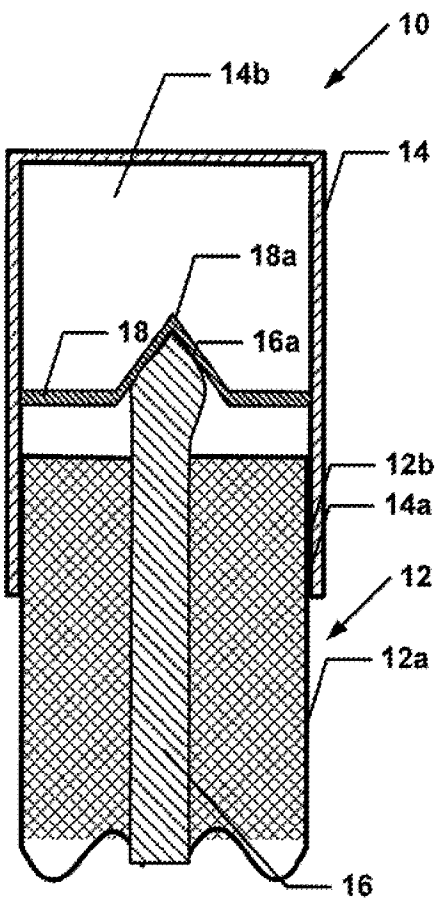
FIG. 1*e* is a cross-sectional view of a cosmetic article in accordance with FIG. 1*a* wherein the cosmetic unit is being shaped.
Figure 1B:
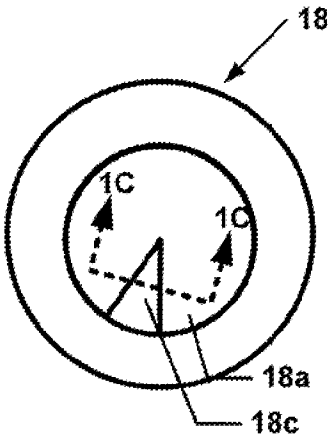
FIG. 1*b* is a planar view of a shaper.
Figure 1C:
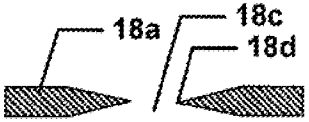
FIG. 1*c* is a partial cross-sectional view of the shaper at a slot of the shaper.
Figure 1D:
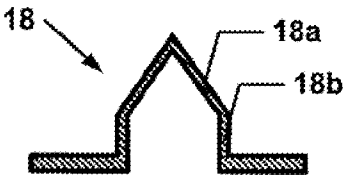
FIG. 1*d* is a cross-sectional view of a shaper having a guide shoulder.
Figure 1A:
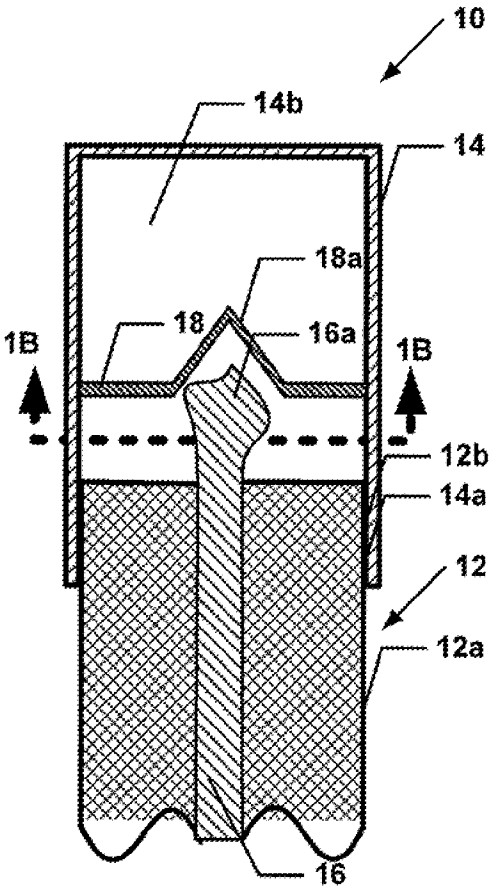
FIG. 1*a* is a cross-sectional view of a cosmetic article in accordance with one embodiment of the present invention.

Because cosmetic article 10 may be any suitable article, cosmetic unit 16 may have any suitable shape. As illustrated with respect to FIGS. 2*c* and 2*d*, the cosmetic unit may be relatively wide and, thus, as compared with FIG. 1*a*, the embodiments of the present invention as depicted in FIGS. 2*e* and 2*f* are then suitably sized.

Figure 2E:
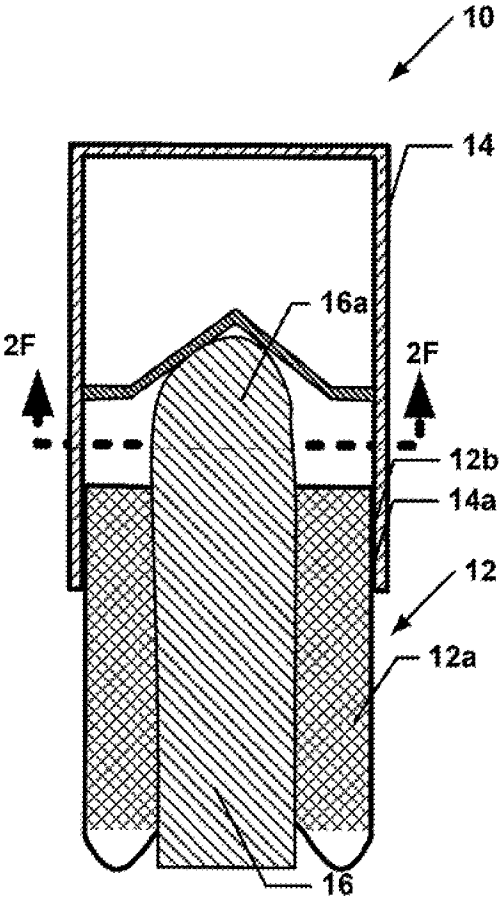
FIG. 2*e* is a cross-sectional view of a cosmetic article in accordance with one embodiment of the present invention.
Figure 2C:
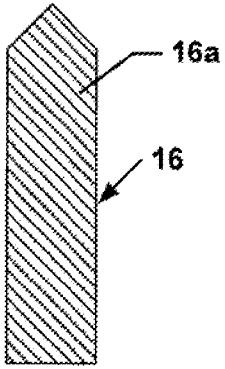
FIG. 2*c* is a cross-sectional view of a second cosmetic unit prior to use.

Returning to FIGS. 1, i.e. FIG. 2*e*, cap 14 may be made of suitable material and may be made by any suitable process, including snap fit assembly. Cap 14 is preferably sized to fit on holder 12 and protect tip 16*a* from external forces. Cap 14 may be an integrated cap or a stand-alone cap.

With respect to FIG. 1*a*, cap 14 includes an inner portion 14*a* that matches a shoulder 12*b* of the body of holder 12 to retain the holder by any suitable means, for example, by frictional fit.

Cap 14 further includes a shaper 18 that shapes and/or defines a tip portion of a cosmetic unit that has become worn. Shaper 18 may be provided by any suitable means in the cap; for example, the shaper may be integral to the cap or it may be inserted and secured by frictional fit or by snap assembly.

Shaper 18 includes a shaping surface 18*a* in the form of a substantially conical or frustroconical surface. The angle of the conical surface may be any suitable angle for the particular material to be shaped and/or defined. Surface 18*a* may be constructed as a cone as shown in FIG. 1, but it or may be the surface of another structure, for example, a plug having a conical surface facing the tip.

Figure 2D:
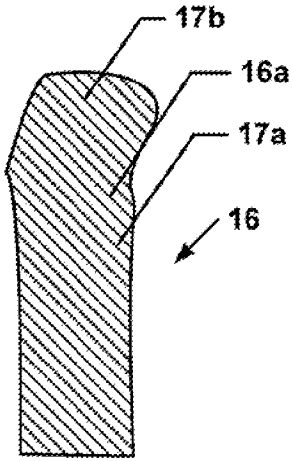
FIG. 2*d* is a cross-sectional view of the second cosmetic unit after use.
Figure 2A:
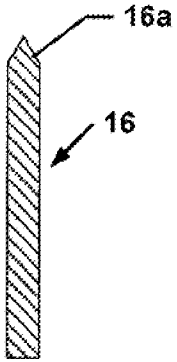
FIG. 2*a* is a cross-sectional view of a first cosmetic unit prior to use.
Figure 2B:
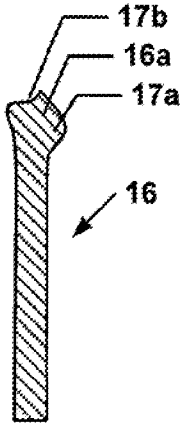
FIG. 2*b* is a cross-sectional view of the first cosmetic unit after use.

Shaper 18 may include a shoulder 18*b* as shown in FIG. 2*d* that guides and/or holds tip 16*a* into the shaper. Shoulder 18*b* is preferably sized to be larger than the cross-sectional diameter of the tip by a predetermined amount to guide the tip and retain it to surface 18*a*.

Surface 18*a* may include one or more slots 18*c* each of which is defined by one or a pair of single-sided or double-sided edges 18*d* that remove a portion of the material of the tip. The material that is removed preferably exits to an inner space 14*b* of the cap. Space 14*b* is preferably suitably sized to retain the accumulated removed material.

In use, when the consumer wishes to apply the cosmetic agent, the holder and cap are moved relatively to each other. The user rotates the cap a predetermined amount before removing the holder from the cap. During the rotation, the shaping surface is moved over the tip and smoothes the outer surface of the tip. Excess material may be drawn off through the slot and/or is smoothed by moving material from an area of accumulated material to an area of reduced material.

To aid in turning the cap relative to the holder, inner portion 14*a* and shoulder 12*b* may be threaded and accordingly engageable. Thus, the shaper 18 may be engaged when the cap is placed on the holder when the consumer has finished the use of the cosmetic article, and also when the cap is removed to use the article.

Yet, inner portions 14*a* and shoulder 12*b* may also be threaded, but the cap may be fit on the holder without turning and removed with or without turning. Thus, the shaper is only engaged at times the consumer desires to do so.

Figure 3B:
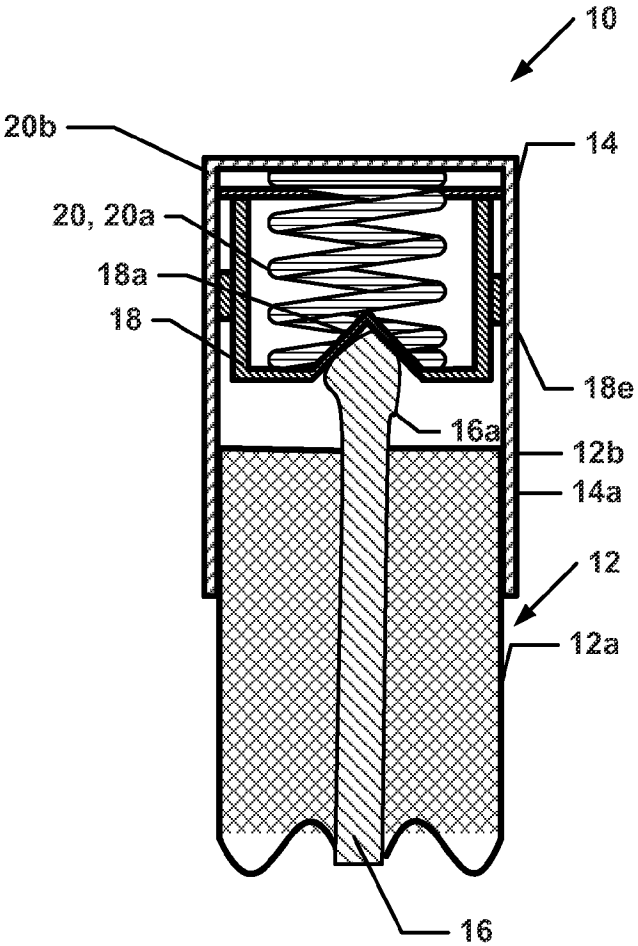
FIG. 3*b* is a cross-sectional view of a cosmetic article of FIG. 3*a* in a second position.
Figure 3A:
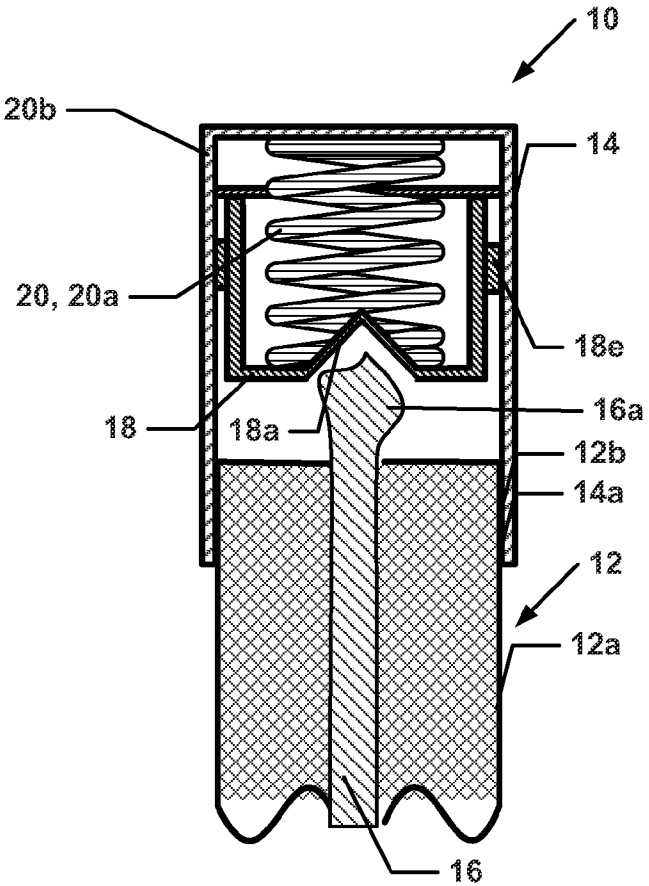
FIG. 3*a* is a cross-sectional view of a cosmetic article in a first position in accordance with a further embodiment of the present invention.

In a further embodiment, with respect to FIGS. 3*a* and 3*b*, shaper 18 may be movably biased with respect to cap 14 along a longitudinal axis. Therein, cap 14 may include a biasing member 20 that moves in one or more longitudinal grooves of the cap into which guides 18*e* are movable. Biasing member 20 includes a bias element 20*a*, such as a spring, that is restrained preferably in a housing 20*b*, such as a sleeve.

Shaper 18 may be located suitable rearward of the opening of the cap that when the holder is engaged in the cap, tip 16*a* does not make contact with the shaper. In that case, when the user wishes to shape the tip, the user engages the holder further into the cap, overcoming perhaps a retaining structure such as a low protrusion, and place the tip against the shaper. The longitudinal force exerted by the user on the tip via the holder determines the degree to which the tip contacts the shaper.

The user then rotates the holder relative to the cap by a predetermined amount causing the tip to rotate relative to the shaper. The shaping surface then is drawn over the tip and the outer surface of the tip is drawn off through the slot and/or is smoothed by moving material from an area of accumulated material to an area of reduced material.

Figure 4:
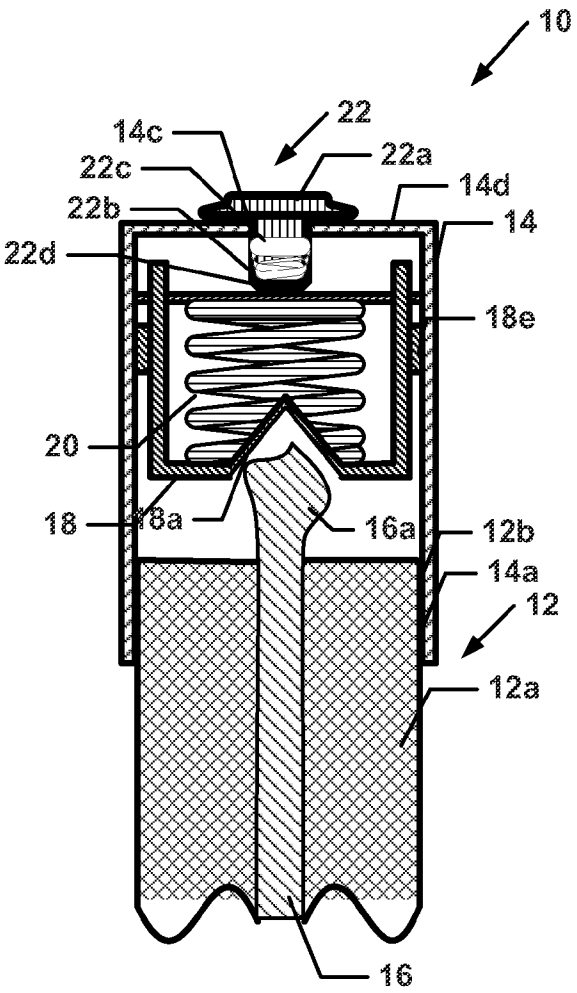
FIG. 4 is a cross-sectional view of a cosmetic article using a push-button in accordance with a further embodiment of the present invention.

With respect to FIG. 4, cap 14 includes a push button 22 for selectively placing shaper 18 in contact with tip 16*a*. Push button 22 is movably secured to an aperture 14*c* through top 14*d* of the cap. A tactile surface 22*a* is connected to a piston 22*b*, which may include a biasing member 22*c*, that passes through the aperture. A piston surface 22*d* transmits the consumer's push to biasing member 22, which in turn brings the shaping surface of the shaper in contact with the tip of the cosmetic unit.

Figures 5A, 5B, 5C, 5D:
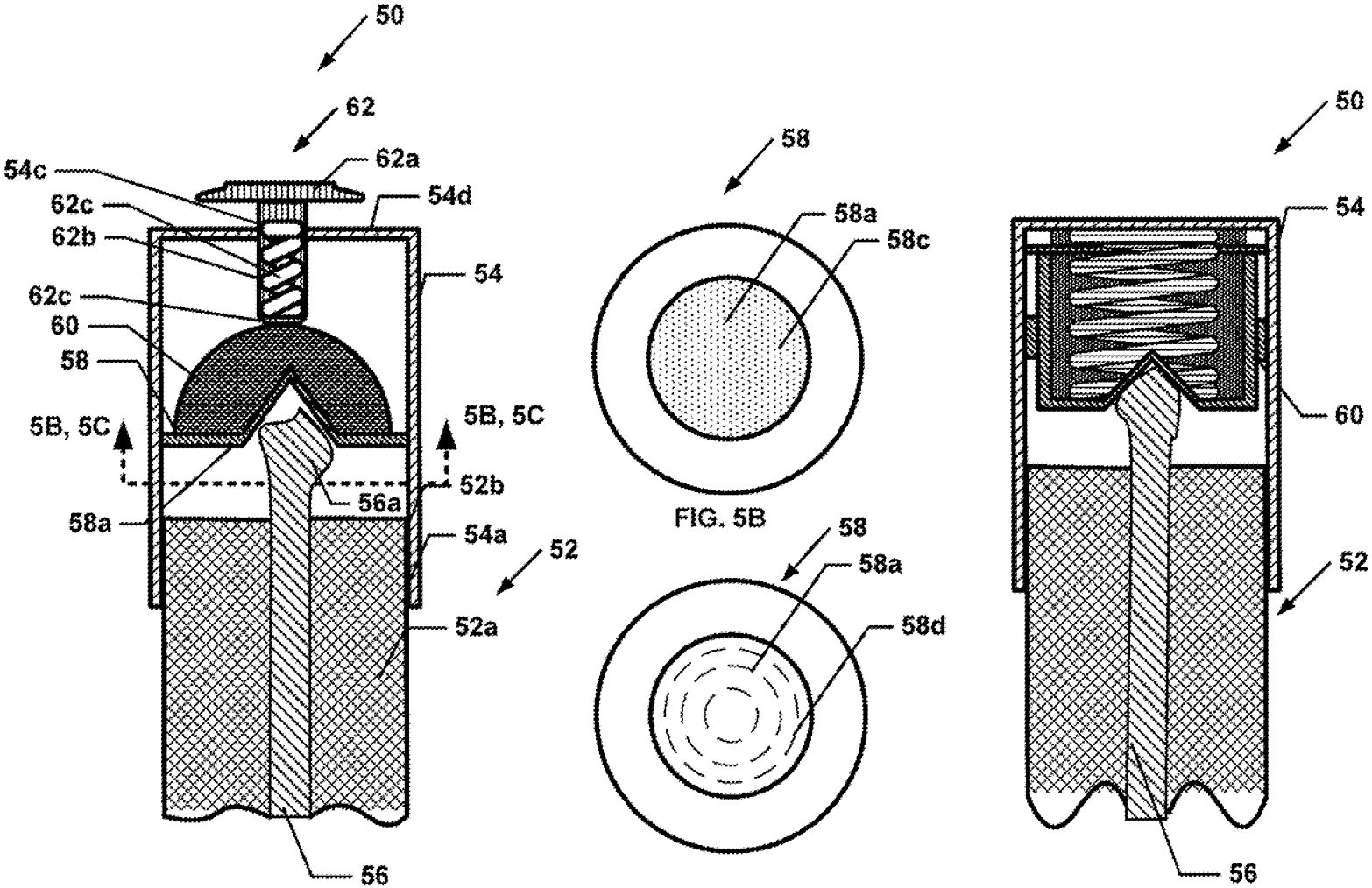
FIG. 5*a* is a cross-sectional view of a cosmetic article using a shaping chemical in accordance with a further embodiment of the present invention.
FIG. 5*b* is a planar view of a shaper in accordance with a further embodiment of the present invention.
FIG. 5*c* is a planar view of a shaper in accordance with a yet further embodiment of the present invention.
FIG. 5*d* is a cross-sectional view of a cosmetic article using a shaping chemical and biasing member in accordance with a further embodiment of the present invention.
Figure 5E:
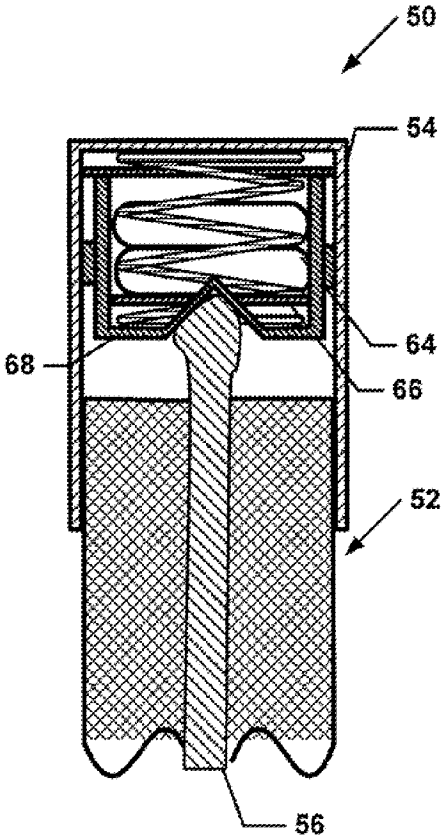
FIG. 5*e* is a cross-sectional view of a cosmetic article using batteries in accordance with a further embodiment of the present invention.
Figure 7A:
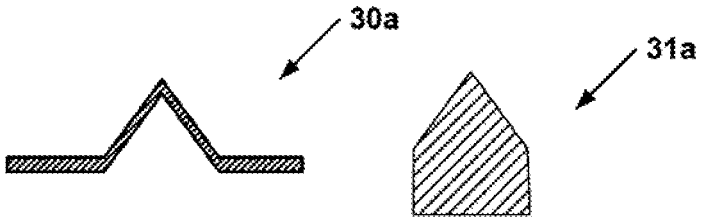
FIGS. 7A-7*e* illustrate a plurality of shapers and resulting shaped tips.
Figure 7B:
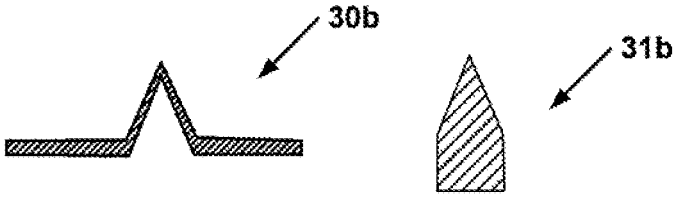
Figure 7C:
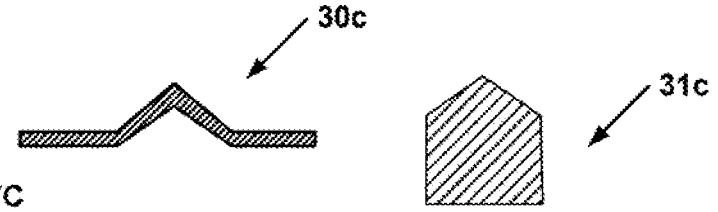
Figure 7D:
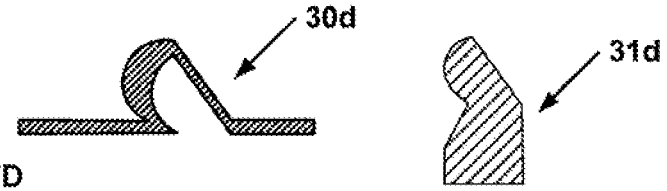
Figure 7E:
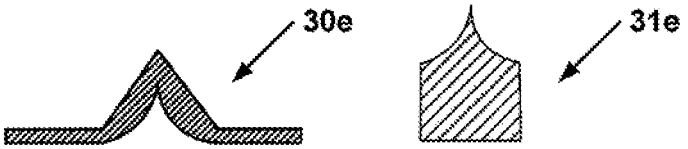

In accordance with a further embodiment of the present invention, as shown in FIG. 5, a cosmetic article 50 includes a holder 52 and a cap 54 that shapes and/or defines a tip portion of a cosmetic unit held by the holder.

Cosmetic article 50 may be any suitable article as one skilled in the art will recognize from the description further herein. In particular, but not exclusively, cosmetic article 50 may be a full-line lipstick, a slim-line lipstick, a trim-line lipstick, an eye shadow, a concealer, a lip liner, an eye liner, a mechanical pencil, or any other suitable article.

Thus, holder 52 may have any suitable shape that is convenient for the user, that is suitable for holding the cosmetic unit, and/or that is desired for any reason. For example, holder may be circular in cross-section and have a small diameter for a lip liner or have a larger diameter for a lipstick. Thus, when holder 52 is a pencil, holder 52 may be polygonal in cross-section, or, for example, holder 52 may be rectangular when it is configured as a full-line lipstick.

The holder comprises a body 52*a* that firmly holds cosmetic unit 56 as is known in the art.

Holder 52 maintains a tip 56*a* of the cosmetic unit exterior to a proximal end of body 52*a* so that a consumer can apply the cosmetic agent of the cosmetic unit to the consumer's body.

Cosmetic unit 56 may be a solid or semi-solid that permits a portion of the tip to be shaped and/or defined to correct the surface when material is unevenly distributed in the tip. For example, cosmetic unit 56 may comprise a material that becomes uneven with high spots and low spots on the surface. Preferably, the material has properties that permit correction.

Thus, when a surface that is less flexible than the material of the cosmetic unit is applied to the cosmetic unit and the cosmetic unit rotates relative to the surface, material moves from the areas of accumulated material to areas of removed material.

Cap 54 may be made of suitable material and may be made by any suitable process, including snap fit assembly. Cap 54 is preferably sized to fit on holder 52 and protect tip 56*a* from external forces. Cap 54 may be an integrated cap or a stand-alone cap.

Cap 54 includes an inner portion 54*a* that matches a shoulder 52*b* of the body of holder 52 to retain the holder by any suitable means, for example, by frictional fit.

Cap 54 further includes a shaper 58 that shapes and/or defines a tip portion of a cosmetic unit that has become worn. Shaper 58 may be provided by any suitable means in the cap; for example, the shaper may be integral to the cap or it may be inserted and secured by frictional fit or by snap assembly.

Shaper 58 includes a shaping surface 58*a* that is capable of being impregnated by or transmitting a shaping chemical disposed in a reservoir 60 that shapes the tip by removing a predetermined portion of the material of the tip. The surface may be in the form of a substantially conical or frustroconical surface and, preferably, a shoulder 58*b* that guides tip 56*a*. The angle of the conical surface may be any suitable angle for the particular material to be shaped and/or defined. Surface 58*a* may be constructed as a cone but it or may also be the surface of another structure, for example, a plug having a conical surface facing the tip.

Shoulder 58*b* is preferably sized to be larger than the cross-sectional diameter of the tip by a predetermined amount to guide the tip and retain it to surface 58*a*.

In use, when the consumer wishes to apply the cosmetic agent, the user rotates the cap a predetermined amount before removing the holder from the cap. Thus, the shaping surface is drawn over the tip and smoothes the outer surface of the tip. Excess material is drawn of through the slot.

To aid in turning the cap relative to the holder, inner portion 54*a* and shoulder 52*b* may be threaded and accordingly engageable. Thus, the shaper 58 may be engaged when the cap is placed on the holder when the consumer has finished the use of the cosmetic article, and also when the cap is removed to use the article.

Yet, inner portions 54*a* and shoulder 52*b* may also be threaded, but the cap may be fit on the holder without turning and removed with or without turning. Thus, the shaper is only engaged at times the consumer desires to do so.

To provide a supply of the shaping chemical, a reservoir 60, disposed in a convenient location, contains predetermined amount of the chemical. The shaping chemical may be any suitable chemical that interacts with one or more compounds in the cosmetic material to cause a physical change in the cosmetic material.

The reservoir may be provided adjacent to the shaper. Thus, a push button 62 may cause a predetermined amount of the chemical to be released.

Push button 62 is provided in cap 54 for selectively placing a shaping chemical via shaper 58 in contact with tip 56*a*. Push button 62 is movably secured to an aperture 54*c* through top 54*d* of the cap. A tactile surface 62*a* is connected to a piston 62*b*, which may include a biasing member 62*c*, that passes through the aperture. A piston surface 62*d* transmits the consumer's push to the reservoir, which in turn release a predetermined amount of the shaping chemical.

Shaping surface 58*a* may comprise a material that absorbs the shaping chemical and becomes impregnated by it. By contact with tip 56*a*, the cosmetic material changes material properties and by being turned by the consumer may be shaped.

In one or more embodiments, the shaping surface may have a plurality of apertures 58*c* or grooves 58*d* that permit the shaping chemical to directly contact tip 56*a*.

The construction of cap 54 may also utilize biasing members and be similar to FIGS. 3*a*, 3*b*, and or 4, as illustrated in FIG. 5*d*. Therein, a release of the shaping chemical from reservoir 60 occurs when the user advances the holder into a shaper 68 causing the shaper to move relative to the cap and compress the reservoir.

In a further embodiment, rather than using a chemical, one or more batteries 64 are provided and are initiated when the user advances the holder into the shaper causing the shaper to move relative to the cap and close a circuit. The batteries provide an electric current to heat a circumferential resistance heater plate 66. Heater plate 66 release a predetermined amount of heat that softens the tip and which by being turned by the consumer may be shaped.

Figure 6C:
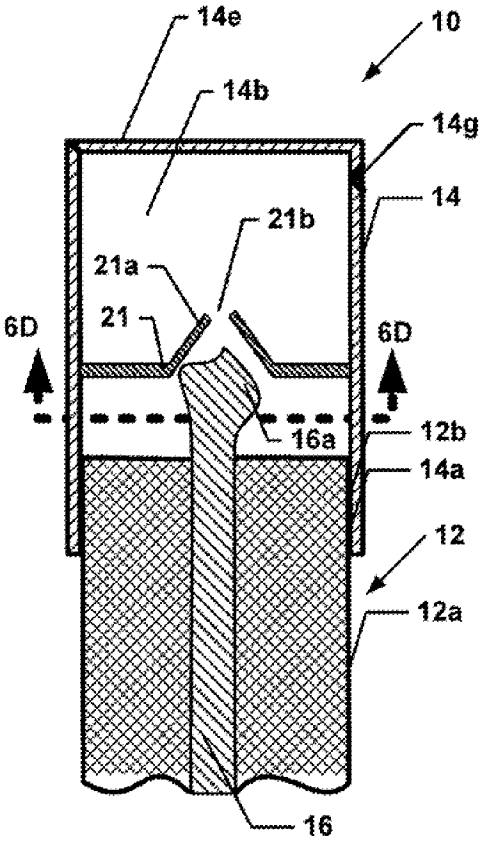
FIG. 6*c* is a cross-sectional view of a cosmetic article using a frustoconical shape in accordance with a further embodiment of the present invention.
Figure 6A:
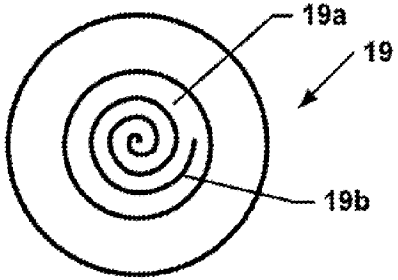
FIG. 6*a* is a planar view of a shaper in accordance with a further embodiment of the present invention.
Figure 6B:
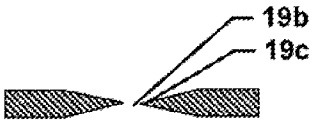
FIG. 6*b* is a partial cross-sectional view of the shaper at a slot of the shaper of FIG. 6*a*.

Similar to FIG. 1*a*, i.e. FIG. 2*e*, in accordance with one embodiment of the present invention, a shaper 19, as illustrated in FIGS. 6*a* and 6*b*, may be used instead of shaper 18.

Shaper 19 includes a shoulder 19*a* and may comprise a continuous or discontinuous slot 19*b* having one or more edges 19*c*.

Therein, the slot may be shaped to be spiral. Thus, when the user rotates the holder relative to the cap, the tip is shaped by edges 19*c*. Since the slot has a spiral shape the degree of rotation may be less than that of slot 18*c*.

Preferably, slot 19*b* is at least spirally circumferential to permit the user instead of or in addition to rotational movement of the holder relative to the cap, i.e. shaper, to use longitudinal movement of the holder relative to the cap, i.e. shaper. When the user moves the holder relative to the cap longitudinally, the tip contacts the shaping surface and a predetermined amount of the outer surface of the tip is drawn off through the slot and/or is smoothed by moving material from an area of accumulated material to an area of reduced material.

In particular, as taught with respect to FIGS. 3*a*, 3*b*, and 4, shaper 19 may also be used where the shaper is associated with a biased member for superior results.

Figure 6D:
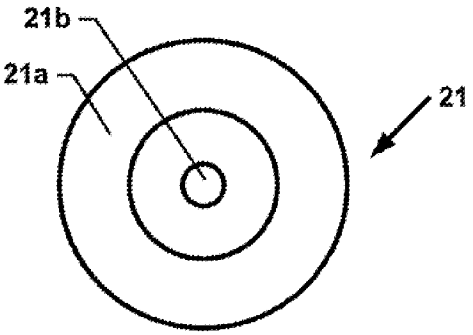
FIG. 6*d* is a planar view of a shaper in accordance with a further embodiment of the present invention.

In a further embodiment, as illustrated at least by FIGS. 6*c* and 6*d*, a shaper 21 comprises a frustroconical shape having a portion 21*a* defining at a distal end an opening 21*b* permitting cosmetic material removed from tip 16*a* to be retained in an inner space 14*b*.

Shaper 21 may be made of a material having relative high frictional properties, such as pumice or a rough wax. In use, the user then rotates the holder relative to the cap by predetermined amount causing the tip to rotate relative to the shaper. The shaping surface then is drawn over the tip and the outer surface of the tip is worn down and/or is smoothed by moving material from an area of accumulated material to an area of reduced material. Preferably, the user has oriented the cosmetic article such that the residue of material that is worn off falls into inner space 14*b* and may be removed via a lid 14*e* in cap 14 hinged by any suitable means including, as is generally known in the art, with a living hinge 14*g*.

As can be readily appreciated, shaper 21 may be suitable used in the structures taught with respect to FIGS. 3*a*, 3*b* and 4.

It should be understood that the above described invention may also be used as a stand-alone unit and need not be incorporated into a cap or may be incorporated into a distal end of the holder.

In one or more embodiments of the present invention, a plurality of shapers 30*a*-30*e*, shown here to be similar to shaper 18, although any shaper taught in the present application such as shaper 19, 21, 58, and 68 may also be suitable, are provided as shown generally in FIGS. 7*a*-7*e* that permit a user to select the type of shape that is most suitable for the tip 31*a*-31*e* used by the user. Thus, a user who would like a very precise and defined line would use a shaper having a high peak, such as the shaper of FIG. 7*b*. A more precise tip may be created using the shaper of FIG. 7*e*, while a blunt tip may be created with suitable shaper such as the one of FIG. 7*c*. A chisel point tip may be created by a shaper having a particular structure, such as the one of FIG. 7*d*.

Each of the plurality of shapers may be provided in an assembly that permits easy and safe insertion and removal from the cap. In addition thereto, or instead of, each of the plurality of shapers may be provided in its own cap. A selection of caps having a different purposed shaper may be provided with a cosmetic article or may be provided separately to permit the user the greatest possible flexibility in the use of one or more cosmetic articles.

Each shaper or shaper provided with a cap may comprise a unique identifier that is suitable for a user to recognize the shape.

In accordance with one embodiment of the present invention, a cosmetic article 100 includes a holder 102 and a cap 104 that shapes and/or defines a tip portion of a cosmetic unit held by the holder.

While cosmetic article 100 may be any suitable article; tile cosmetic article preferably is configured to have a cosmetic unit that includes a chisel point tip.

Holder 102 comprises a body 102*a* that firmly holds cosmetic unit 106 as is known in the art. Holder 102 maintains a tip 106*a* of the cosmetic unit exterior to a proximal end of body 102*a* so that a consumer can apply the cosmetic agent of the cosmetic unit to the consumer's body.

Cosmetic unit 106 may be a solid or semi-solid that permits a portion of the tip to be shaped and/or defined to correct the surface when material is unevenly distributed in the tip as previously discussed and having material properties that permit shaping, i.e. correction.

Cap 104 may be made of suitable material and may be made by any suitable process, including snap fit assembly. Cap 104 is preferably sized to fit on holder 102 and protect tip 106*a* from external forces. Cap 104 may be an integrated cap or a stand-alone cap.

Figures 8A, 8B, 8C, 8D, 8E, 8F, 8G, 8H:
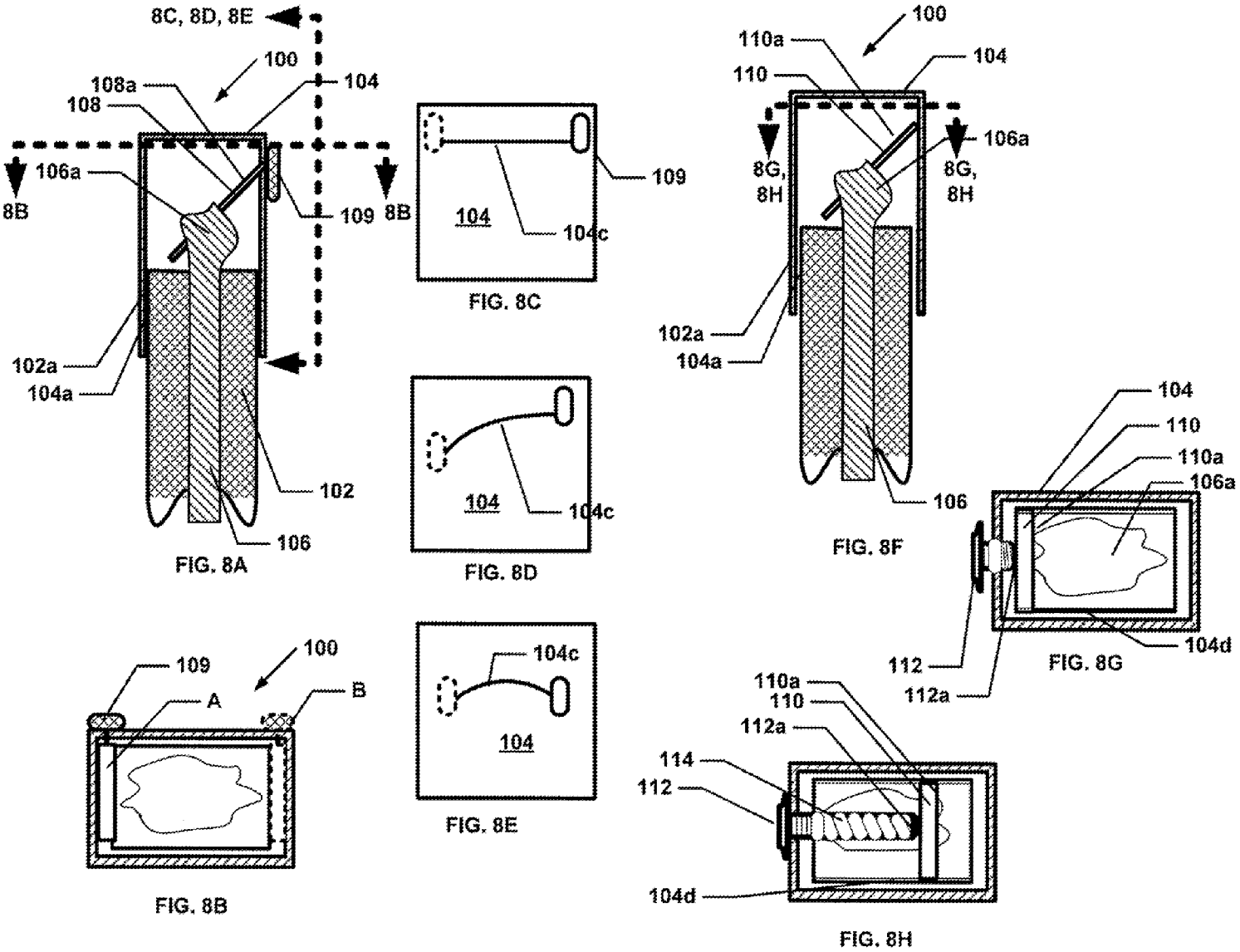
FIG. 8*a* is a cross-sectional view of a cosmetic article in accordance with a further embodiment of the present invention.
FIG. 8*b* is a cross-sectional view of the cosmetic article of FIG. 8*a*.
FIGS. 8*c*-8*e* are side views of the cosmetic article of FIG. 8*a*.
FIG. 8*f* is a cross-sectional view of a cosmetic article in accordance with a further embodiment of the present invention.
FIG. 8*g* and 8*h* are cross-sectional views of the cosmetic article of FIG. 8*f* having a shaper in a first and second position, respectively.

With respect to FIG. 8*a*, cap 104 includes an inner portion 104*a* that matches a shoulder 102*b* of the body of holder 102 to retain the holder by any suitable means, for example, by frictional fit.

Cap 104 further includes a shaper 108 that shapes and/or defines a tip portion of a cosmetic unit that has become worn. Shaper 108 may be provided by any suitable means in tie cap; for example, the shaper may be integral to the cap or it may be inserted and secured by frictional fit or by snap assembly.

Shaper 108 includes surface 108*a* having one or more blade edges 108*b* that preferably extend from a proximal location at a wall of cap 104 to a distal location at or near an opposing wall of the cap. Cap 104 further includes a user operable grasp 109 connected to the shaper. The grasp and/or the shaper travel in a guide 104*c* provided in the cap. As illustrated in FIGS. 8*c*-8*e*, the guide may be straight, sloping, curved or any other shape and aid in the shaping of the tip.

In use, a user moves shaper 108 along guide travels from a first position A to a second position B or vice versa, as illustrated in FIG. 8*b* and removes a portion of tip 106*a* to form a chisel point tip or other suitable tip.

In one or more embodiments illustrated with respect to FIGS. 8*f*-8*h*, shaper 110 similar to shaper 108, having one ore more blade edges 110*a*, travels in one or more guides 104*d* provided in the inner walls of the cap. A user operable button 112 is provided and placed in operative communication with the shaper via a piston 112*a*. Button 12 may include a biasing member 114 that extends the reach of the piston from a first position and retracts the shaper.

While the invention has been described in conjunction with specific embodiments, it is to be understood that many alternatives, modifications, and variations will be apparent to those skilled in the art in light of the foregoing description.

What is claimed is:

1. A shaper for defining a tip portion of a cosmetic unit that has become worn, the shaper comprising a cap associated with a holder holding the cosmetic unit, said cap comprising:

a reservoir;

a shaping chemical held within the reservoir, wherein the shaping chemical interacts with one or more compounds in the cosmetic material to cause a physical change in the cosmetic material; and a shaping surface, which shaping surface transmits the shaping chemical which is released from the reservoir to the tip portion to smooth a surface of the tip portion, the shaping surface user-selectably placed in contact with the tip portion.

2. The shaper of claim 1, wherein the shaping surface comprises a plurality of apertures for transmitting the shaping chemical.

3. The shaper of claim 1, wherein the shaping surface comprises a plurality of grooves for transmitting the shaping chemical.

4. The shaper of claim 1, wherein the shaping surface comprises a material that absorbs the shaping chemical and becomes impregnated by it.

5. The shaper of claim 1 wherein the cap further comprises a biasing member disposed in the cap, the biasing member for keeping the shaping surface from contacting the tip portion until a user selectably places the shaping surface in contact with the tip portion.

6. The shaper of claim 1 further comprising a push button for user selectably placing the shaping surface in contact with the tip portion.

* * * * *